United States Patent [19]

Schutz et al.

[11] Patent Number: 4,581,083

[45] Date of Patent: Apr. 8, 1986

[54] ROLL PRODUCT TAIL SECURING SYSTEM

[75] Inventors: Rudolph W. Schutz, Walnut Creek; Rudolf R. Weis, Antioch, both of Calif.

[73] Assignee: Crown Zellerbach Corporation, San Francisco, Calif.

[21] Appl. No.: 435,009

[22] Filed: Oct. 18, 1982

[51] Int. Cl.[4] ..... B65D 85/67

[52] U.S. Cl. ..... 156/64; 156/187; 156/191; 156/215; 156/360; 156/363; 156/285; 156/497; 156/444; 156/446; 156/475

[58] Field of Search ..... 156/64, 187, 191, 215, 156/356, 360, 363, 378, 446, 444, 447, 475, 184, 285, 497; 53/390, 118; 271/12

[56] References Cited

U.S. PATENT DOCUMENTS

| | | | |
|---|---|---|---|
| 2,668,675 | 2/1954 | Wolfe | 53/118 |
| 3,052,073 | 9/1962 | Johansen | 53/118 |
| 3,367,589 | 2/1968 | Chant et al. | 53/390 |
| 3,442,064 | 5/1969 | Conti | 53/390 |
| 3,691,727 | 9/1972 | Doerschein | 53/390 |
| 3,724,167 | 4/1973 | Pizmoht | 53/390 |
| 3,887,177 | 6/1975 | Farfaglia et al. | 271/12 |
| 3,890,182 | 6/1975 | Terry | 156/184 |
| 3,960,272 | 6/1976 | Hartbauer | 156/184 |
| 4,111,737 | 9/1978 | Wesley | 156/187 |
| 4,154,438 | 5/1979 | Seragnoli | 271/12 |

OTHER PUBLICATIONS

Brooke et al, "Sheet . . . Transport" Xerox Disclosure Journal, vol. 4, No. 1 (1/79) pp. 55.

*Primary Examiner*—Jerome Massie

*Attorney, Agent, or Firm*—Thomas R. Lampe

[57] ABSTRACT

A system for securing the unaffixed tail of a roll product to a convolution thereof underlying the tail with a flexible sealing element wherein a predetermined physical characteristic of the roll product is sensed and an appropriate sealing element such as a label is delivered to the roll product and applied thereto.

11 Claims, 13 Drawing Figures

ROLL PRODUCT TAIL SECURING SYSTEM

BACKGROUND OF INVENTION

1. Field of Invention

This invention relate to an apparatus and method for securing the unaffixed tail of a roll product to a convolution thereof underlying the tail with a flexible sealing element such as a label.

2. Description of the Prior Art

A wide variety of devices are known in the prior art for applying labels or other flexible sealing elements to roll products. Such prior art arrangements are characterized by their complexity and consequent high cost In addition, such devices often cannot readily be used to apply the labels to roll products having different physical characteristics, such as differing lengths. When the sealing element is a label, for example, the label will in all probability have indicia imprinted thereon that is only applicable to a given size of roll product. Consequently if a roll product of a differing size were introduced into the system an incorrect and misleading label would be applied. Even though some prior art systems may be adjusted to accommodate different sized roll products such change over will in most cases render the system appropriate for only one type of roll product without another adjustment being made. That is, such systems do not lend themselves to receiving and sealing more than one size of roll product at any given time. This drawback means that a manufacturer of roll products of various sizes may be required to employ a separate tail sealing and labelling machine in conjunction with each converting machine producing a different sized roll product. This obviously adds to the overall cost of producing the roll products and the machinery is utilized inefficiently.

BRIEF SUMMARY OF THE INVENTION

The present system for securing the unaffixed tail of a roll product to a convolution thereof underlying the tail with a flexible sealing element has the ability to accommodate roll products, such as paper towels or the like, of different sizes. The system automatically senses a predetermined physical characteristic of the roll product and delivers to the roll product an appropriate flexible sealing element such as a label appropriate to the sensed characteristic. In the preferred embodiment illustrated herein the sensed physical characteristic is the length of the roll product and a label correctly identifying that length will be delivered to the roll product and applied thereto so that the label is positioned on both the tail and the convolution of the roll product underlying the tail. If a roll product having a different physical characteristic such as a different length is introduced subsequently into the system, a different label will automatically be selected, delivered to the roll product and secured thereto. This arrangement does away with the necessity of manual adjustments being made to accommodate roll products with different physical characteristics. This flexibility enables the system of the present invention to be employed in the labelling of roll products having different physical characteristics coming from a plurality of converting stations upstream.

DETAILED DESCRIPTION

Figure 1:
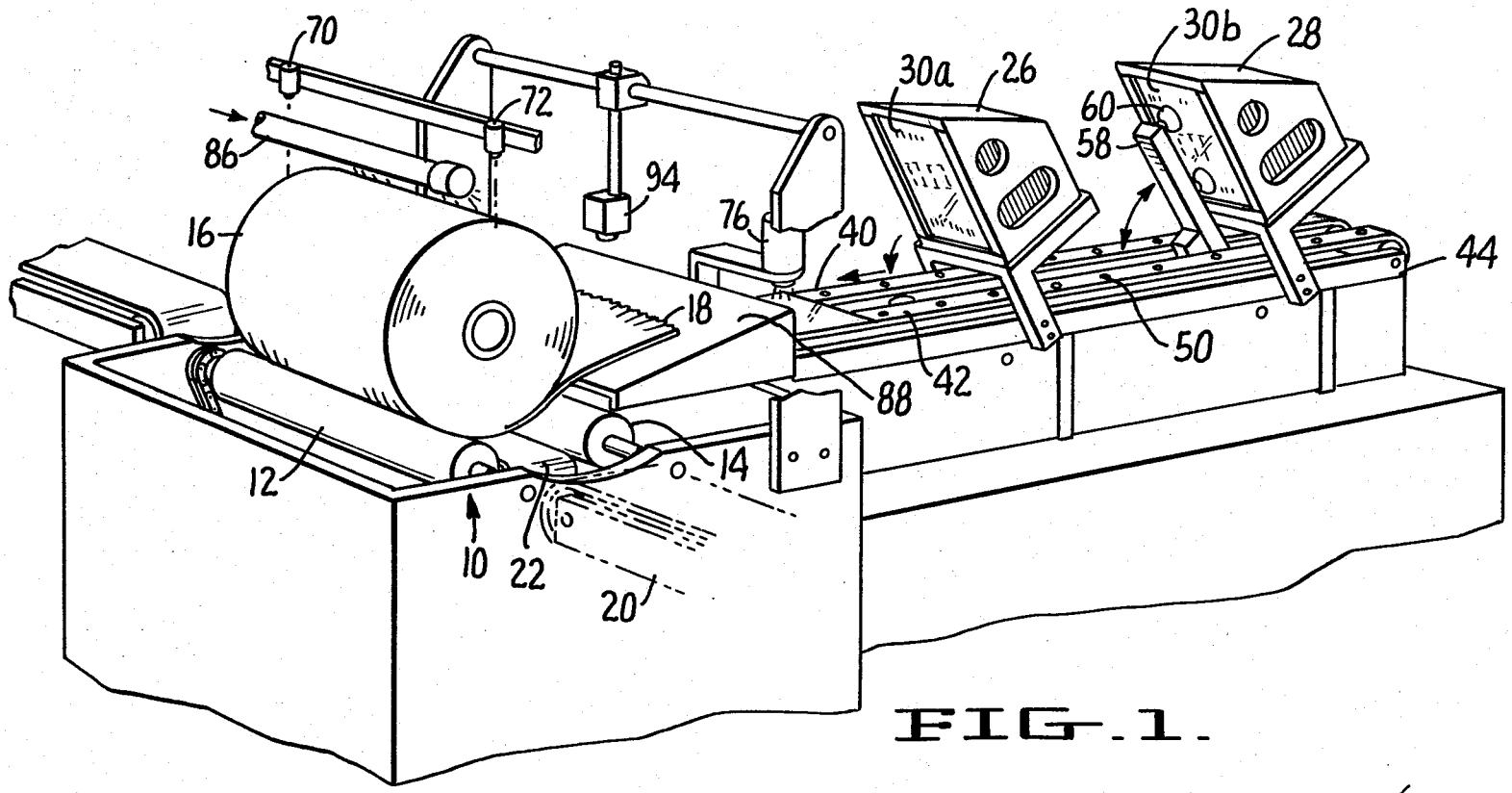
FIG. 1 is a perspective view of a preferred form of apparatus constructed in accordance with the teachings of the present invention.
Figure 2:
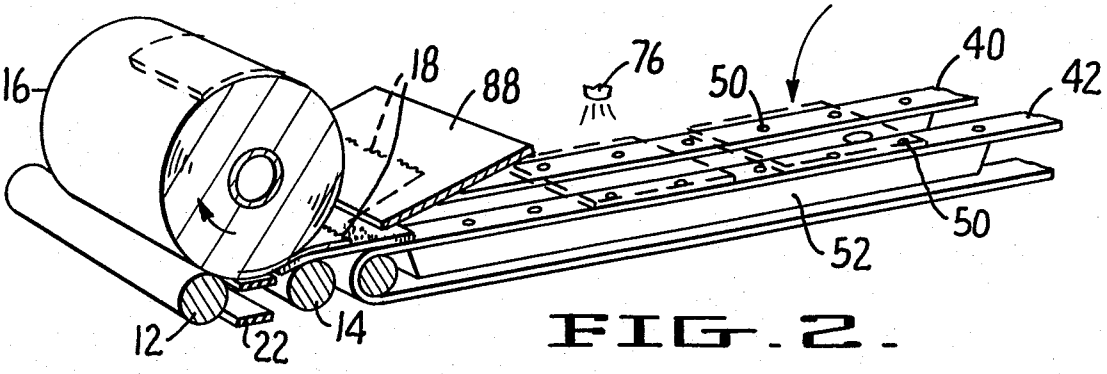
FIG. 2 is a perspective view of selected portions of the apparatus of FIG. 1 providing a schematic illustration of the operation thereof.

Referring now to the drawing, a prefererd form of apparatus for carrying out the teachings of the present invention is illustrated. The apparatus includes a roll product receiving station indicated generally by reference numeral 10 which includes selectively rotatable rollers 12 and 14 for receiving and supporting thereon a roll product 16 having an unsecured tail 18. It is a function of the apparatus to apply labels or other flexible sealing elements to the tail 18 and a convolution of the roll product underlying the tail. Any suitable means may be employed to deliver the roll product end wise into position over the rollers 12 and 14, one such suitable means being a belt conveyor 20 shown in phantom in FIG. 1. Belt conveyor 20 delivers the roll product to a second belt conveyor 22 comprising part of the roll product receiving station and disposed between rollers 12 and 14. A suitable mechanism (not shown) is preferably employed to raise and lower belt conveyor 22 relative to the rollers in a manner well known in the art. When belt conveyor 22 is in raised position it provides full support for the roll product and prevents the roll product from engaging the rollers. When the belt conveyor 22 is lowered, on the other hand, it is out of engagement with the roll product and the rollers 12 and 14 provide full support for the roll product. It will be appreciated that the conveyor 22 is in raised position when it receives the roll product from conveyor 20.

Figure 4:
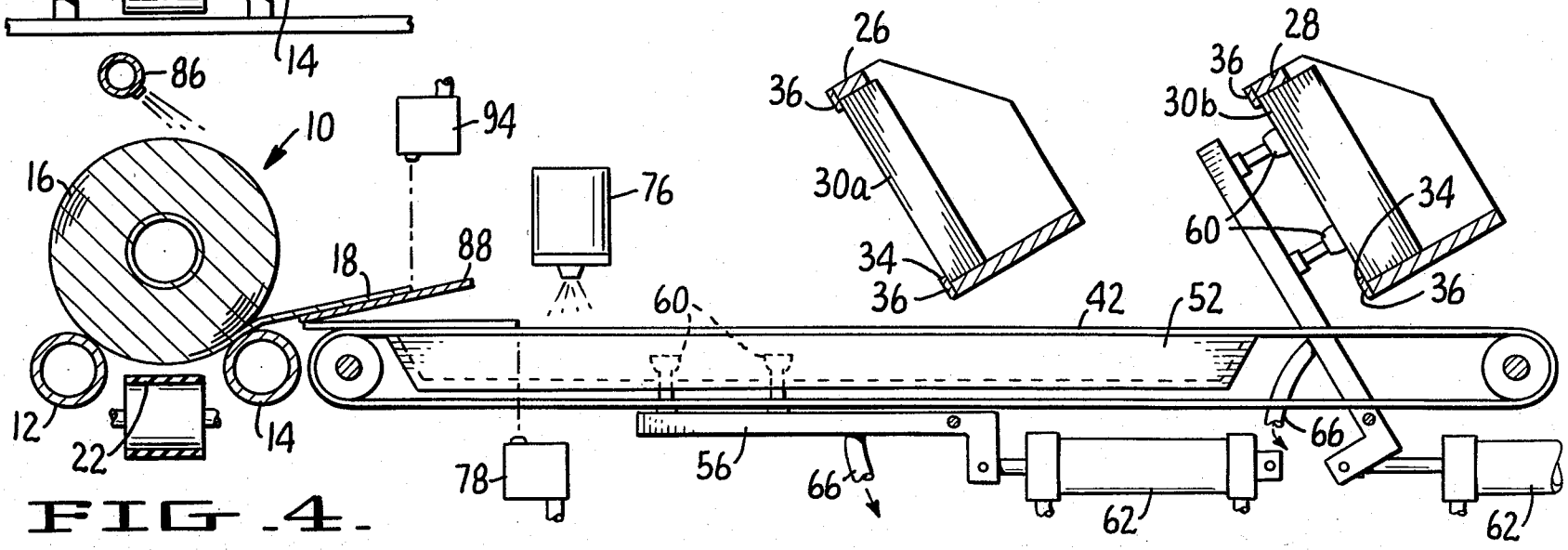
FIG. 4 is a side elevational view of the apparatus portions shown in FIG. 3.

The labels or other sealing elements to be secured to the roll product are maintained in sealing element supply stations 26 and 28. Station 26 contains labels **30*a* and station 28 contains labels 30*b*. The labels may if desired be of the same size but they ordinarily have imprinted thereon indicia describing a physical characteristic of the roll product such as the length thereof. Consequently, it is important that the correct label be applied to the correct roll product. As may perhaps best be seen with reference to FIG. 4, each supply station is in the form of a magazine for containing a supply of sealing elements in stacked relationship. Each of the magazines has an opening 34 which is tilted at an angle to the horizontal so that the labels are continually urged toward the opening under the influence of gravity. In the absence of an outside force being applied to the labels. They are retained in the magazine by lips 36** defining the opening.

Sealing element supply stations 26 and 28 are mounted over conveyor means in the form of two conveyor belts 40 and 42 disposed in parallel and defining a space therebetween. Conveyor belts 40 and 42 are mounted for movement on support rollers rotatably journaled on the apparatus framework 44. The conveyor belts 40 and 42 have apertures 50 formed therein which provide communication between the upper surface of the conveyor belts and a vacuum box 52 positioned thereunder.

Figure 3:
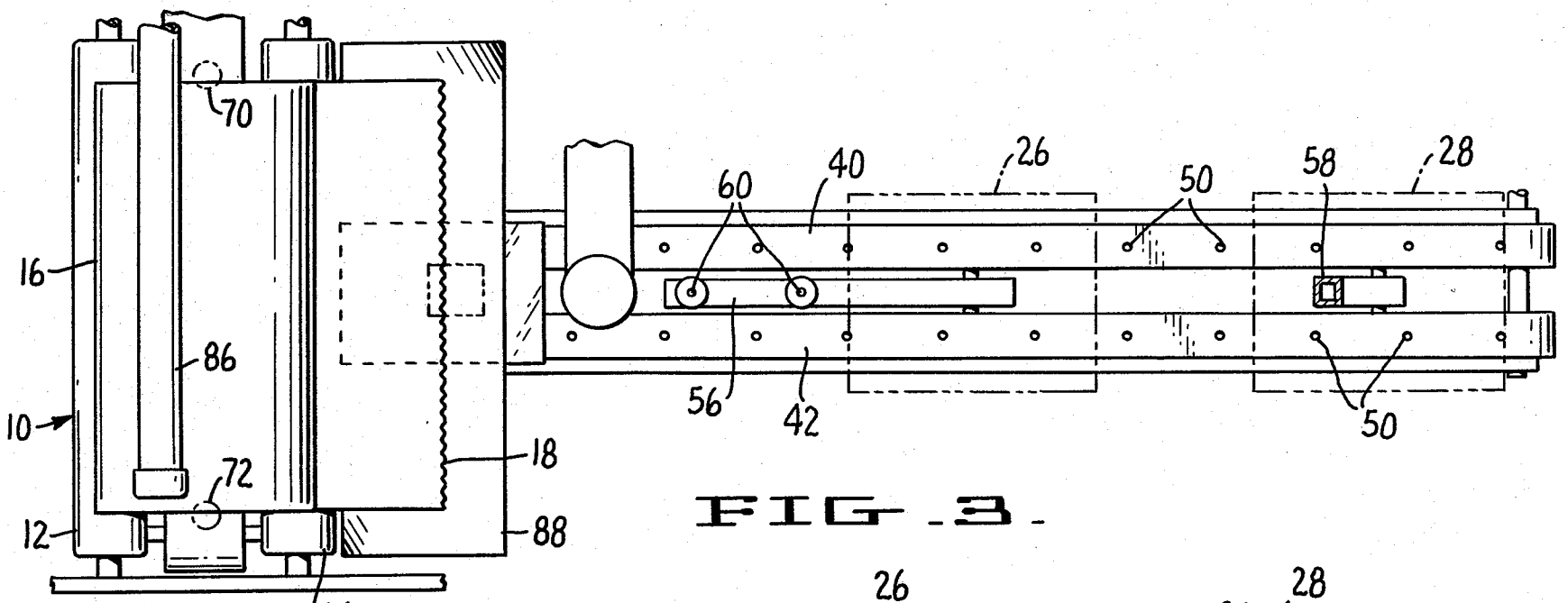
FIG. 3 is a plan view of selected portions of the apparatus of FIG. 1.

Removal means is provided for removing the labels 30*a* and 30*b* from their respective magazines and transporting the labels to conveyor belts 40 and 42. More specifically, and as may perhaps best be seen with reference to FIGS. 3 and 4, the removal means includes two reciprocatable elements in the form of pivotally mounted arms 56 and 58 having vacuum cups 60 disposed thereon as illustrated. Each arm is pivotally mounted at one end thereof on apparatus framework 44 and is in the form of an L-shaped bellcrank. Each arm is connected to a suitable pneumatic prime mover 62 which when actuated will cause the arm to move from the retracted position occupied by arm 56 in FIG. 4 to the pick up station occupied by arm 58 in FIG. 4. In this latter position the vacuum cups associated with the arm will contact the outermost label of the magazine with which the arm is associated. Vacuum is supplied to the vacuum cups through a conduit 66 leading thereto from a suitable source (not shown) of vacuum. Through a suitable conventional valving arrangement (not shown) the vacuum to cups 60 is shut off after the arm again moves into retracted position and the label 30*a* or 30*b* attached to the cups engages conveyor belts 40 and 42. The vacuum supplied by vacuum box 52 through apertures 50 will then cause the labels to be retained on the upper surface of the belts.

Having desribed generally the primary components of apparatus constructed in accordance with the teachings of the present invention, the cooperative relationship of the components and their operation in carrying out the method of the present invention will now be described. This operational relationship and function may perhaps best be understood by referring to FIGS. 5–13 and the sequential steps of operation illustrated therein. In the interest of simplicity, the control system employed to control the operational relationship and function of the components will not be described in detail since such control systems are well within the capabilities of one skilled in the art.

Figure 5:
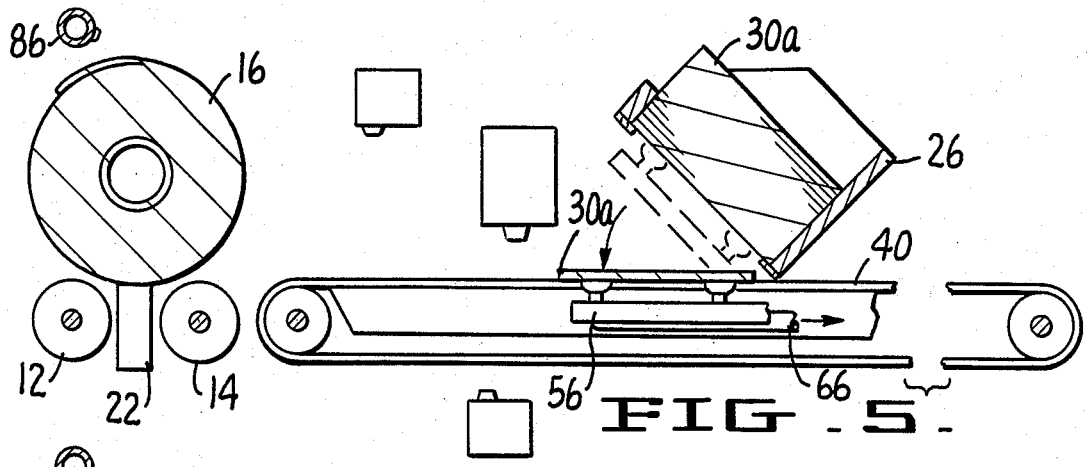
FIGS. 5–13 illustrate in schematic fashion sequential steps of the method of the invention.

In FIG. 5 a roll product 16 is illustrated being delivered end wise into the roll product receiving station by belt conveyor 22 which is in a raised position to maintain the roll product out of engagement with rollers 12 and 14. As the roll product moves into the receiving station a predetermined physical characteristic of the roll product, i.e. the length thereof, is sensed by sensing means in the form of photoelectric devices 70 and 72 of any suitable type mounted above the receiving station. Through a suitable control system belt conveyor 22 will halt movement when the leading edge of the roll product intersects the beam from photoelectric device 70. Photoelectric device 72, on the other hand, senses the length of the roll product delivered to the receiving station. If the distance between devices 70 and 72 is greater than the length of the roll product the beam from photoelectric device 72 will not be interrupted. If, on the other hand, the roll product is greater in length than the distance between photoelectric devices 70 and 72 the beam from device 72 will be interrupted. Depending upon which of these two conditions exists one or the other of labels 30*a* and 30*b* will be removed from their respective magazines, delivered to conveyor belts 40, 42 and applied to the roll product in a manner to be described below. In FIG. 5 arm 56 has been actuated and the vacuum cups 60 attached thereto brought into engagement with the outermost label 30*a* at station 26. Through a suitable mechanism the arm 56 will immediately return to its retracted position leaving the removed label 30*a* on top of the conveyor belts 40 and 42.

Figure 6:
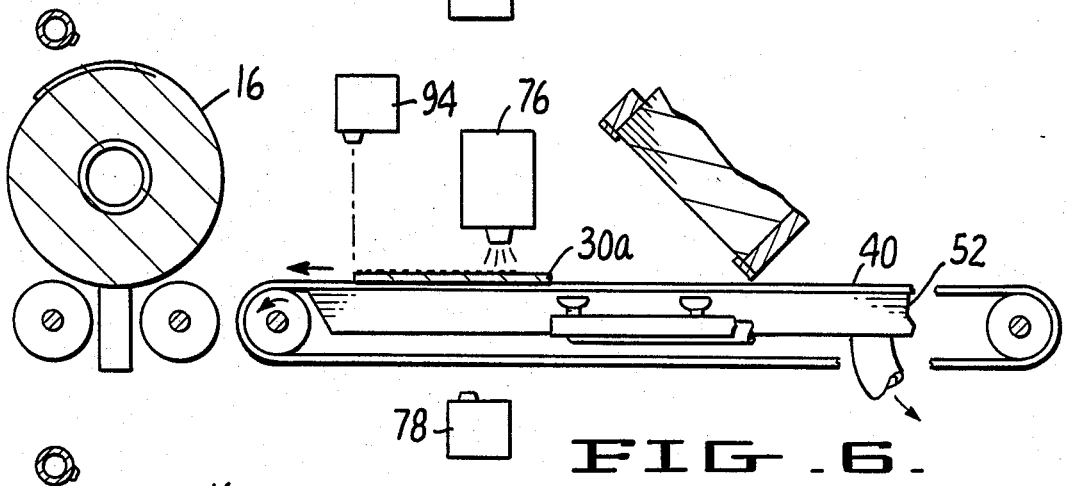
Figure 7:
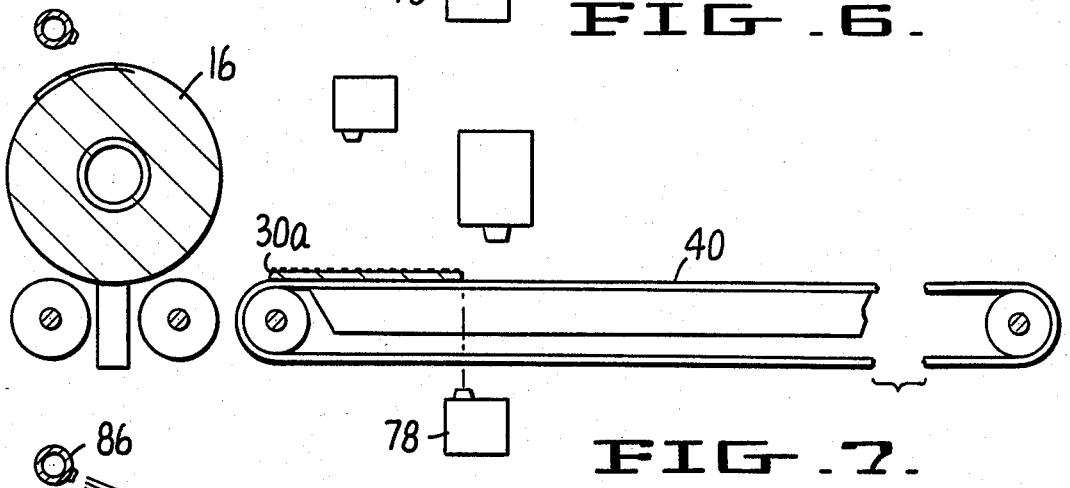
Figure 8:
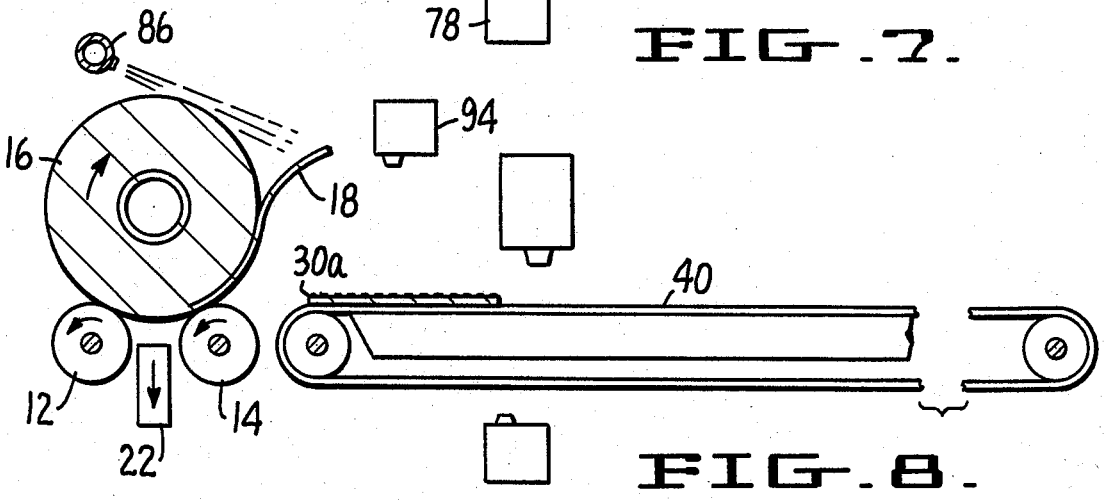
Figure 9:
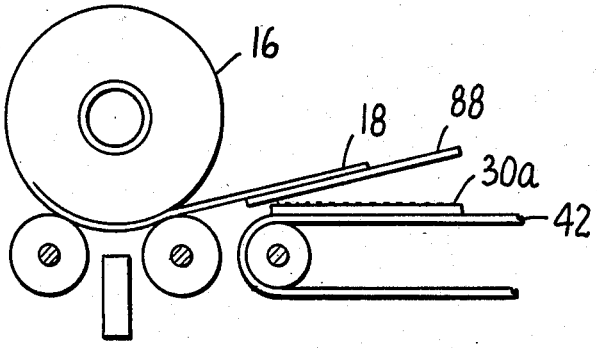

Conveyor belts 40 and 42 will then move in counter clockwise direction as viewed in FIG. 6 to transport label 30*a* in the direction of roll product 16. During this stage of the operation the upper surface of the label 30*a* is rendered in an adhesive condition. Assuming, for example, that the upraised surface of the label has previously had glue applied thereto and dried thereon, the adhesive condition is created by passing the glued surface under a water spray device 76. Alternatively, of course, spray device 76 could be used to apply a wet glue to a previously non-glue bearing surface. Movement of conveyor belts 40, 42 temporarily ceases when the trailing edge of label 30*a* reaches the beam of photoelectric device 78 disposed under the path of movement thereof as shown in FIG. 7. The next stage of operation is shown in FIG. 8 whereat the conveyor 22 is dropped to retracted position and the rollers 12 and 14 commence rotation in a counter clockwise direction as viewed in that figure. This causes the roll product 16 to rotate in a clockwise direction, that is, the direction tending to wind the tail of the roll product about the remainder thereof. Substantially simultaneously with this operation an air jet 86 disposed above the roll product directs a blast of air against the tail and causes same to be positioned on a platform 88 (FIG. 1) disposed over the path of movement of label 30*a*. The air blast will continue until the trailing edge of the tail 18 passes under the beam of yet another photoelectric device 94 which functions to cut off air to jet 86 through any suitable valving arrangement. Photoelectric device 94 in response to this condition will also cause renewed movement of conveyor belts 42 and 40.

Figure 10:
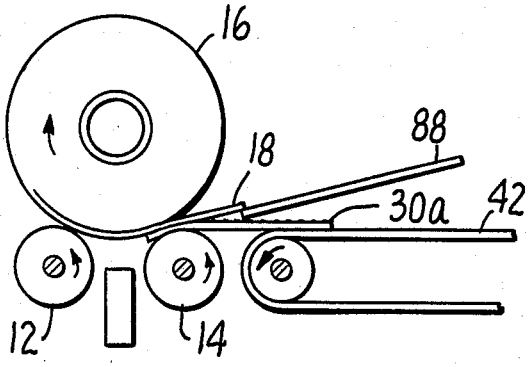
Figure 11:
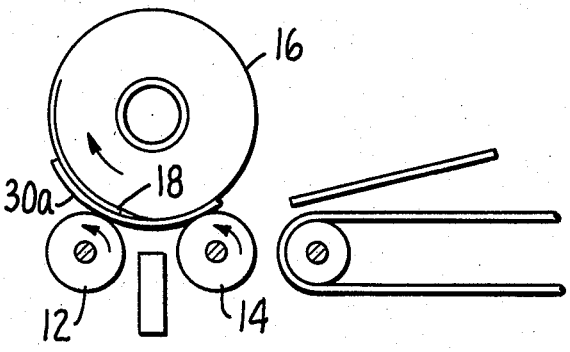
Figure 12:
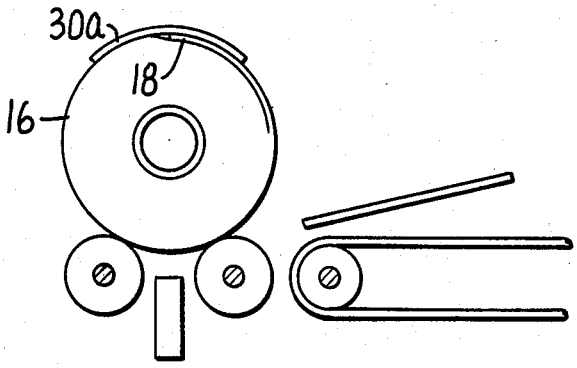
Figure 13:
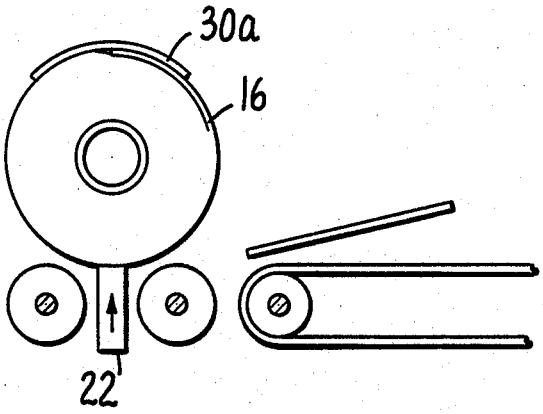

The label 30*a* will be delivered by the conveyor belts at the same speed at which tail 18 is moving due to rotation of roll product 16 by rollers 12 and 14. What happens next is best illustrated by the sequential FIGS. 9–13. First, the label 30*a* passes through the space defined by platform 88 and conveyor belts 40 and 42. The label 30*a* then passes through a nip defined by the roll product 16 and roller 14 as shown in FIG. 10. The label 30*a* will be affixed to the tail 18 at this point due to the adhesive nature of the upper surface of the label and due to the nip pressure between the roll product and roller 14. Continued rotation of rollers 12 and 14 will completely wind the tail 18 over its underlying convolution and label 30*a* will, as shown in FIG. 11, be pressed into engagement with both the tail and the underlying convolution by passing through the two nips defined by rollers 12 and 14 and product 16. FIG. 12 shows the label 30*a* disposed at the top of the roll product and secured into position. The final stage of operation is illustrated in FIG. 13 wherein belt conveyor 22 is again moved to raised position, actuated, and delivers the sealed roll product out of the receiving station.

We claim:

1. Apparatus for securing the unaffixed tail of a roll product to a convolution thereof underlying said tail with a flexible sealing element at a predetermined fixed location relative to both said convolution and said tail, said sealing element adapted to identify a predetermined physical characteristic of said roll product, said apparatus comprising, in combination:

a roll product receiving station for receiving a roll product having an unaffixed tail;

sensing means for sensing a predetermined physical characteristic of said roll product;

a plurality of sealing element supply stations, each said station comprising a magazine adapted to contain a plurality of said sealing elements;

sealing element removal means operatively associated with said sensing means for removing a sealing element from a selected one of said magazines responsive to a predetermined physical characteristic being sensed by said sensing means whereby the removed sealing element corresponds to said sensed physical characteristic of said roll product;

conveyor means disposed adjacent to said magazines and between said removal means and said receiving station for conveying the sealing element from said removal means to a roll product at said receiving station; and means for securing the conveyed sealing element to both said roll product tail and the convolution underlying said tail at a predetermined fixed location relative to both said convolution and said tail.

2. The apparatus of claim 1 wherein said removal means comprises a plurality of reciprocatable elements, each said reciprocatable element movable from a first position whereat a sealing element is removed from one of said magazines by said removal means to a second position whereat said sealing element is transferred from said reciprocatable element to said conveyor means.

3. The apparatus of claim 2 wherein said conveyor means includes two conveyor belts disposed in parallel and defining a space therebetween, said reciprocatable elements being mounted for movement in said space.

4. The apparatus of claim 3 wherein said reciprocatable elements include pivotally mounted arms and vacuum means on said arms for selectively applying a vacuum to said sealing elements.

5. The apparatus of claim 1 including means for rendering a surface of said conveyed sealing element adhesive while said sealing element is conveyed by said conveyor means, said conveyor means and said roll product forming a nip for receiving said sealing element with the adhesive surface thereof in engagement with the roll product.

6. The apparatus of claim 5 additionally comprising means for rotating said roll product with said sealing element adhesive surface in engagement therewith at both said tail and the convolution underlying said tail to secure said sealing element to said roll product.

7. A method for securing the unaffixed tail of a roll product to a convolution thereof underlying said tail with a flexible sealing element at a predetermined fixed location relative to both said convolution and said tail, said sealing element adapted to identify a predetermined physical characteristic of said roll product, said method comprising the steps of:

positioning a roll product having an unaffixed tail at a predetermined location;

sensing a predetermined physical characteristic of said roll product;

responsive to the sensed predetermined physical characteristic of the roll product, selecting and removing a sealing element from a selected one of a plurality of sealing element sources whereby the removed sealing element corresponds to said sensed physical characteristic;

conveying said selected sealing element in its entirety to said roll product;

bringing said selected sealing element into engagement with said roll product; and adhesively securing said selected sealing element to both the tail of said roll product and the convolution underlying said tail at a predetermined fixed location relative to both said convolution and said tail.

8. The method of claim 7 wherein the step of conveying said selected sealing element is carried out by supporting said selected sealing element on a movable support surface.

9. The method of claim 8 additionally comprising the steps of temporarily halting movement of said movable support surface with the selected sealing element spaced from said roll product, positioning the tail of said roll product over said sealing element and simultaneously rotating said roll product and resuming movement of said movable support surface to rewind said tail about the remainder of said roll product and bring said sealing element into engagement with both said tail and the convolution underlying said tail.

10. The method of claim 9 wherein the step of positioning said tail is carried out by blowing said tail into engagement with said sealing element and partially rewinding said tail about the remainder of said roll product until the end of the tail is located at a predetermined location on said sealing element.

11. The method of claim 7 wherein the predetermined physical characteristic that is sensed is the length of said roll product.

* * * * *